United States Patent [19]

Howell

[11] 4,158,251

[45] Jun. 19, 1979

[54] BUTTON CONSTRUCTION FOR TUFTED BOAT UPHOLSTERY

[75] Inventor: George Howell, Windsor, Canada

[73] Assignee: Detroit Marine Engineering Corporation, Detroit, Mich.

[21] Appl. No.: 887,522

[22] Filed: Mar. 17, 1978

[51] Int. Cl.[2] ..... A44B 1/00; A47G 3/00

[52] U.S. Cl. ..... 24/152; 24/90 B; 24/113 MP; 85/55; 85/53; 5/408

[58] Field of Search ..... 24/90 A, 90 B, 113 MP, 24/102 T, 152; 85/55, 53; 5/356

[56] References Cited

U.S. PATENT DOCUMENTS

| | | | |
|---|---|---|---|
| 1,315,832 | 9/1919 | Hardinge | 85/53 |
| 2,067,814 | 1/1937 | Bangs | 24/113 MP |
| 2,087,074 | 7/1937 | Tucker | 24/90 A |
| 3,298,272 | 1/1967 | Henderson | 85/53 |

FOREIGN PATENT DOCUMENTS

| | | | |
|---|---|---|---|
| 525170 | 6/1929 | Fed. Rep. of Germany | 24/90 B |
| 1393446 | 2/1965 | France | 85/55 |
| 618169 | 2/1961 | Italy | 85/55 |
| 896367 | 5/1962 | United Kingdom | 24/90 A |

*Primary Examiner*—Bernard A. Gelak

*Attorney, Agent, or Firm*—Harness, Dickey & Pierce

[57] ABSTRACT

A button construction which enables upholstery to be formed and held in tufted shape with concealed nails and without the danger of accidental dislodgement of the button. The button comprises a round holding member having a central recess for receiving the nail head, and a cover member insertable in said recess so as to be flush with the holding member. The tuft will only exert upward pressure on the fastened holding member and there will be no tendency of any portion of the assembly to be dislodged by upward pressure.

3 Claims, 2 Drawing Figures

Fig. 1.
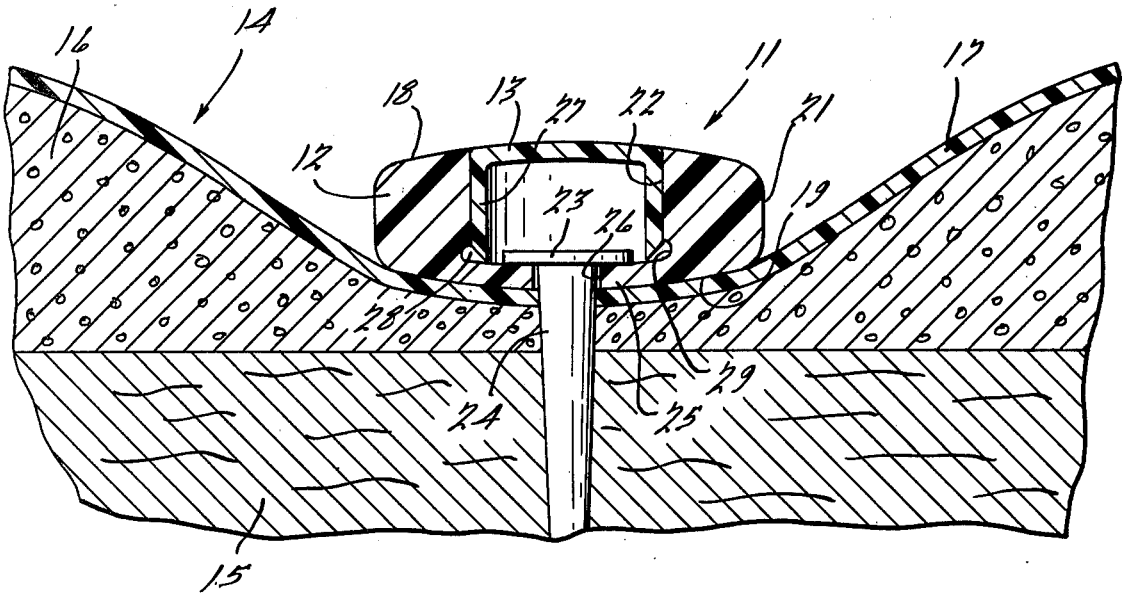
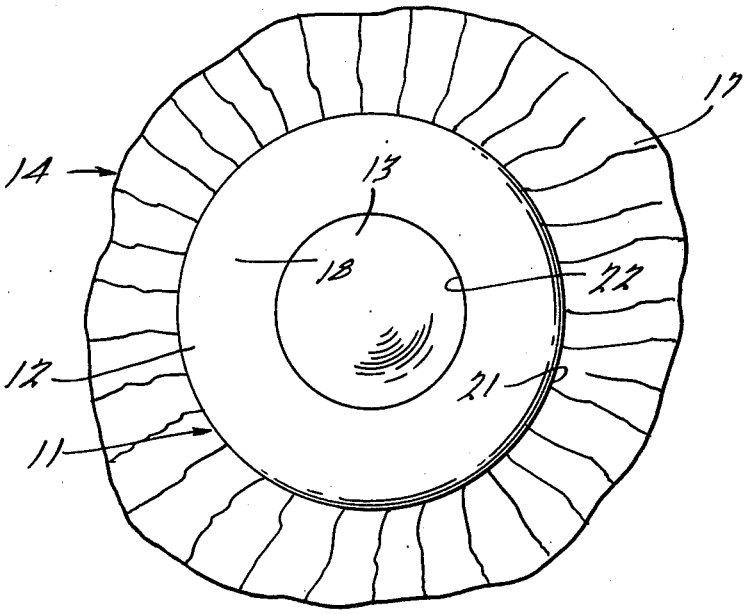
Fig. 2.

BUTTON CONSTRUCTION FOR TUFTED BOAT UPHOLSTERY

BACKGROUND OF THE INVENTION

1. Field of the Invention

The invention relates to button constructions for tufted upholstery and particularly to installations such as marine use where a board or other rigid flat backing member supports cushioning material which is encased by a plastic, cloth or leather cover. The upholstery in such cases is often given a tufted appearance by the fastening of buttons at spaced intervals to the board, the filling at these points being compressed.

2. Description of the Prior Art

There are a number of different ways of mounting such buttons, but a drawback to prior constructions is the danger of a fastened button "popping off" or being dislodged by upward pressure from the adjacent filling material. A typical example is a construction in which one element of a snap fastener is secured by a screw to the backing board so as to hold down the upholstery, and a button carrying a complementary snap fastener element is pressed into the first element. The button will receive upward pressure from the upholstery which will create a tendency for the button to be dislodged.

BRIEF SUMMARY OF THE INVENTION

It is an object of the present invention to provide a novel and improved button construction for tufted upholstery of this type which minimizes the danger of dislodgement of the button and at the same time provides the essential concealment and decorative qualities needed for this environment.

It is another object to provide a button construction of this character which has a part to be fastened to the supporting board and another part to be snapped into the first part, but where the removal pressure from the upholstery does not affect the snap-on part.

It is still another object to provide an improved button construction of this character which is economical to construct and easy to install.

Briefly, the button construction comprises a holding member having a predetermined thickness and a central recess therein, said recess having a relatively thin bottom wall with central means for permitting a fastener such as a headed nail to penetrate through the wall and secure the holding member to an upholstery backing board, and a cover member of inverted cup shape inserted in said recess, the side wall of said cover member having a height such that the central portion of the cover member will be flush with the upper surface of the holding member when the cover member is inserted in the recess.

BRIEF DESCRIPTION OF THE DRAWINGS

FIG. 1 is a cross-sectional view of a portion of upholstery showing the backing board with the button of this invention mounted thereon, and FIG. 2 is a top plan view of the button of FIG. 1.

DESCRIPTION OF THE PREFERRED EMBODIMENT

The upholstery button is generally indicated at 11 and comprises a holding member 12 and a cover member 13. The button is intended to be used in conjunction with an upholstered seat or other upholstered surface generally indicated at 14. The seat comprises a flat supporting member such as a board 15, a layer of compressible filler material 16 on the board, and a cover 17 for the filler compressible material which may be plastic, leather or cloth. As is the normal practice, button 11 is intended to be secured to board 15 by pressing it down against cover 17 so that the material 16 is compressed. With properly spaced buttons, the seat will then assume a tufted appearance.

In accordance with the invention, holding member 12 is round and fabricated of a suitable material such as moldable plastic. The holding member has an upper surface 18 and a lower surface 19 which are preferably slightly rounded and tapered toward each other, being joined on the outside by a side wall 21.

The main portion of holding member 12 is relatively thick but a recess 22 is centrally formed therein. This recess is considerably wider than the head 23 of a nail 24 which is used to fasten the button to board 15.

A relatively thin wall 25 is formed at the bottom of recess 22, this wall having a central opening 26 for the reception of nail 24 so that head 23 will bear against the top of wall 25.

Cover member 13 is of inverted cup shape and has an annular side wall 27 fitting snuggly within the side wall of recess 22. The lower edge of wall 27 has an annular protuberance 28 which snaps within a complementary groove 29 at the bottom of recess 22. The height of cover member 13 is such that, when inserted, it will be flush with surface 18 and continue the softly rounded shape thereof.

In operation, holding member 12 will be pressed down against cover 17 at the proper location and nail 24 driven into position through opening 26 until the filler material 16 is compressed and holding member 12 secures the adjacent upholstery firmly in its compressed position. Cover member 13 will then be inserted in recess 22 until it snaps into position. The result will be an attractive upholstery button which is not subject to removal or dislodgement by upward pressure of the surrounding upholstery material, since this pressure will be taken by holding member 12 and transmitted directly to nail 24.

While it will be apparent that the preferred embodiment of the invention disclosed is well calculated to fulfill the objects above stated, it will be appreciated that the invention is susceptible to modification, variation and change without departing from the proper scope or fair meaning of the subjoined claims.

I claim:

1. An upholstery button construction comprising a holding member with upper and lower surfaces having a predetermined thickness and a central recess therein having a side wall of constant radial size over the major portion thereof, said recess having a single relatively thin continuous central bottom wall with central means for permitting a fastener such as a headed nail to penetrate through the wall and secure the holding member to an upholstery backing board, said wall being imperforate around said central means, and a hollow cover member inserted in said recess, the side wall of said cover member having a dimension such that it engages said recess side wall and having a height such that the entire end wall of the cover member is flush with said upper surface of the holding member when the cover member is inserted in the recess.

2. The combination according to claim 1, the lower portions of said recess and cover member having a complementary continuous annular groove and ridge construction whereby the cover member will snap into place when it is inserted in the recess and be retained therein.

3. The combination according to claim 1, said holding member being round and having upper and lower surfaces which are tapered toward each other.

* * * * *